US007059482B2

(12) United States Patent
Reid et al.

(10) Patent No.: US 7,059,482 B2
(45) Date of Patent: Jun. 13, 2006

(54) WINDOW COVERING SAMPLE DISPLAY DEVICE AND METHOD

(75) Inventors: Patrick Reid, Middleton, WI (US); Morton Kader, Chicago, IL (US); Stephanie Husk, Atlanta, GA (US); Brian Lump, Oak Park, IL (US); Michael P. Eckert, Lake Bluff, IL (US)

(73) Assignee: Springs Window Fashions LP, Middleton, WI (US)

( * ) Notice: Subject to any disclaimer, the term of this patent is extended or adjusted under 35 U.S.C. 154(b) by 76 days.

(21) Appl. No.: 10/395,513

(22) Filed: Mar. 24, 2003

(65) Prior Publication Data

US 2004/0188364 A1 Sep. 30, 2004

(51) Int. Cl.
*A47F 7/16* (2006.01)

(52) U.S. Cl. ..... 211/45; 211/50; 211/118; 211/87.01

(58) Field of Classification Search ..... 211/45, 211/49.1, 86.01, 118, 85.29, 59.1, 57.1, 50, 211/87.01, 106.01; 40/497; 248/683, 467, 248/205.5, 206.3, 309.2; 206/829
See application file for complete search history.

(56) References Cited

U.S. PATENT DOCUMENTS

| | | | | | |
|---|---|---|---|---|---|
| 1,246,629 | A | | 11/1917 | McLaren | |
| 1,847,403 | A | | 3/1932 | Loughmam | |
| 2,315,566 | A | * | 4/1943 | Watral et al. | 211/123 |
| 2,357,320 | A | | 9/1944 | Fruitman | |
| 2,493,530 | A | | 1/1950 | DeSaussure | |
| 2,876,980 | A | * | 3/1959 | Salter | 248/683 |
| 3,000,113 | A | | 9/1961 | Olson | |
| 3,738,550 | A | | 6/1973 | Van Etta et al. | |
| 3,775,870 | A | | 12/1973 | Griggs et al. | |
| 4,632,241 | A | * | 12/1986 | Brough et al. | 206/764 |
| 4,984,693 | A | * | 1/1991 | Belokin et al. | 211/88.01 |
| 4,986,426 | A | * | 1/1991 | Niklaus | 211/85.2 |
| D314,482 | S | | 2/1991 | Walter et al. | |
| 4,991,807 | A | * | 2/1991 | Radnich | 248/206.3 |
| 5,137,158 | A | * | 8/1992 | Brockway | 211/106.01 |
| 5,232,189 | A | * | 8/1993 | Koch | 248/309.1 |
| 5,241,768 | A | | 9/1993 | Thompson | |
| 5,313,337 | A | * | 5/1994 | Byers | 359/872 |
| D383,327 | S | | 9/1997 | Loflin | |
| D392,138 | S | | 3/1998 | Wu | |
| D393,961 | S | | 5/1998 | Whitehead et al. | |
| 5,765,699 | A | * | 6/1998 | Griffin | 211/70.6 |
| 5,913,433 | A | * | 6/1999 | Belokin et al. | 211/90.01 |
| 5,915,573 | A | * | 6/1999 | Drower et al. | 211/89.01 |
| D418,707 | S | | 1/2000 | Lowe | |
| D433,838 | S | | 11/2000 | O'Hara | |
| 6,155,523 | A | * | 12/2000 | Pitre | 248/206.5 |
| 6,237,885 | B1 | * | 5/2001 | Mitchell | 248/205.4 |
| 6,330,948 | B1 | * | 12/2001 | Leto | 211/70.6 |
| 6,588,606 | B1 | * | 7/2003 | Miller et al. | 211/88.01 |

* cited by examiner

*Primary Examiner*—Jennifer E. Novosad
(74) *Attorney, Agent, or Firm*—Lerner, David, Littenberg, Krumholz & Mentlik, LLP

(57) ABSTRACT

An apparatus for displaying samples of window coverings including a base having a front and a rear and at least one suction cup mounted on the rear of the base and adapted to releasably engage a flat surface. The base includes at least one support. The support is adapted to releasably receive and hold a first fabric sample and a second fabric sample, such that the samples are suspended substantially parallel to the flat surface. The second fabric sample is positioned at a greater distance from the flat surface than the first fabric sample, to define a space between the first and second fabric samples.

18 Claims, 6 Drawing Sheets

WINDOW COVERING SAMPLE DISPLAY DEVICE AND METHOD

FIELD OF THE INVENTION

This invention relates to window coverings and, more particularly, to display devices which allow decorators and purchasers to preview how various shade materials will appear on their windows before the shades are manufactured.

BACKGROUND OF THE INVENTION

The past several decades have been marked by tremendous growth in the types of window covering materials that are available to purchasers. Starting with roller shades and slatted horizontal blinds, the field of window coverings has blossomed to include a wide array of different types of coverings. These have included pleated shades, Roman shades, cellular shades and many others.

To compound the number of choices available to customers, in each of the aforesaid categories, numerous types of fabric are available, and each type of fabric is often available in a broad range of colors, patterns and the like.

Among these many choices, there are shade materials which are transparent to some degree, as well as shade materials which are much more opaque, keeping out a much greater degree of light and providing a greater degree of privacy than is offered by shade materials that are substantially transparent.

To compound even further the difficulty in choosing among the many offerings available in the marketplace is the advent and increased popularity of double shades. As illustrated, for example, in U.S. Pat. No. 5,205,334 in the name of Ren Judkins, double shades provide an opportunity to employ two completely different types of shades mounted together to cover the same window. With such double shades, the user has the ability to deploy only one of the two shades (which may, for example, be a relatively sheer pleated shade), or to only deploy the second shade, which may be a more opaque roller shade, or to deploy both at the same time. Because of the enormous number of possible choices of shade materials, compounded by the number of different sizes that may be needed, double shades are often purchased and manufactured on a custom basis.

A problem that is faced by the buyer is to envision how two different shade materials, which may seem appealing in a sample book or the like, will look on the particular window for which the shade is being purchased. It is often difficult to know whether a shade fabric will coordinate well with the paint or wall covering on the walls near the window, particularly when the shade material may have a different appearance depending on how much sunlight may be entering the room through the window in question.

While this difficulty is a concern with single shades, the difficulty is compounded when a customer is selecting two different shade materials to be used together in a double shade. In those instances, the customer will want to have a preview of how two different shade fabrics will look together as part of the same double shade, in terms of their colors, patterns, and their ability to block or transmit light.

One old—and inadequate—solution is to simply hold samples of the materials up by hand near the window which is to be covered. One drawback to doing this is obvious: one cannot step back more than a couple of feet to see how the shade material will look on the window if one is holding up the sample. The problem is compounded further when one wishes to preview two samples of shade material to be used together in a double shade. In this instance, it would be desirable for both samples to be held near and substantially parallel to the window, and spaced apart from each other by a distance that at least approximates the spacing that will exist when the two shade fabrics are mounted to a double shade.

Accordingly, a need has arisen for an apparatus for displaying samples of window coverings which will allow samples to be readily and releasably mounted to a window to permit the user to preview how the window shade material will appear on that window. In addition, such apparatus should permit two samples of shade material to be suspended, one behind the other, with the samples spaced apart to an extent which approximates the distance by which the two different shade materials will be separated if an when they are later used in a double shade.

SUMMARY OF THE INVENTION

The present invention addresses the foregoing needs.

One aspect of the present invention provides an apparatus for displaying samples of window coverings which comprise a base having a front and a rear. At least one suction cup is mounted on the rear of the base and is adapted to releasably engage a flat surface, such as a window. There is at least one support on the base, which support is adapted to releasably receive and hold a first fabric sample, such that the first fabric sample is suspended substantially parallel to the flat surface.

In one preferred embodiment, the support comprises at least one projection extending outwardly from the front of the base. The support is adapted to receive a fabric sample having an opening sized to fit over and be supported by the projection. As a further feature of the invention, the at least one projection has a plurality of support positions adapted to support fabric samples at varying distances from the front of the base.

In another preferred embodiment of the present invention, the base includes first and second end portions. The at least one support comprises a recess in the surface of each of the end portions. The recesses are adapted to receive and releasably hold a first fabric sample which includes a hanger having a knob mounted on each end, with the knobs in the recesses. As a further feature of the invention, each of the end portions has a plurality of recesses, thus defining a plurality of pairs of recesses. Each pair of recesses is adapted to receive the knobs associated with a different fabric sample. The depths of the pairs of recesses differ, such that each fabric sample is suspended a different distance from the flat surface.

Yet a further aspect of the present invention provides a method for displaying samples of window coverings comprising the provision of an apparatus of the type described, mounting the apparatus on a window, and mounting a fabric sample on the apparatus. As a further feature of the method aspect of the present invention, a second fabric sample may be mounted to the apparatus, and positioned at a predetermined distance from the first fabric sample.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION OF PREFERRED EMBODIMENTS

Figure 1:
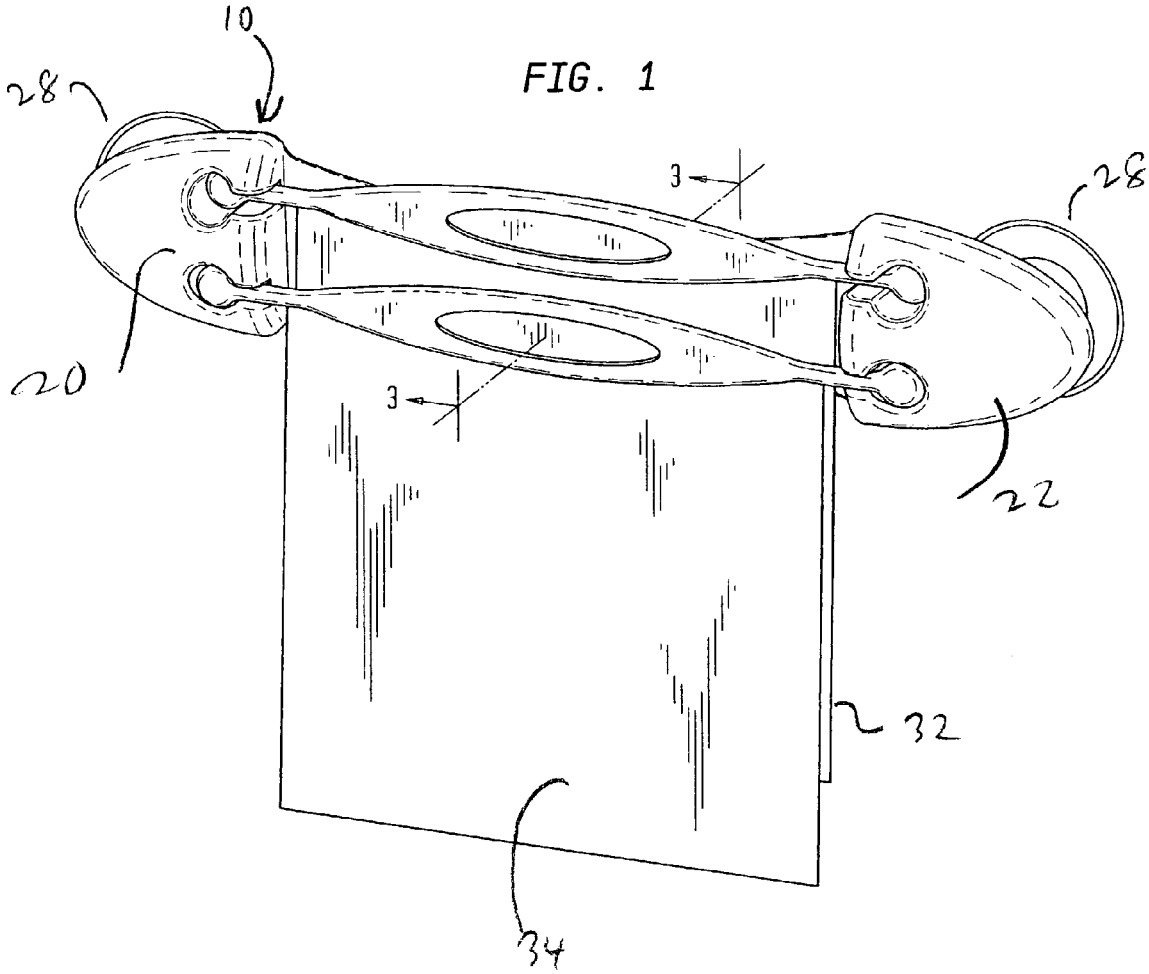
FIG. 1 is a perspective view of a first embodiment of the apparatus of the present invention with two window covering samples mounted thereon.
Figure 2:
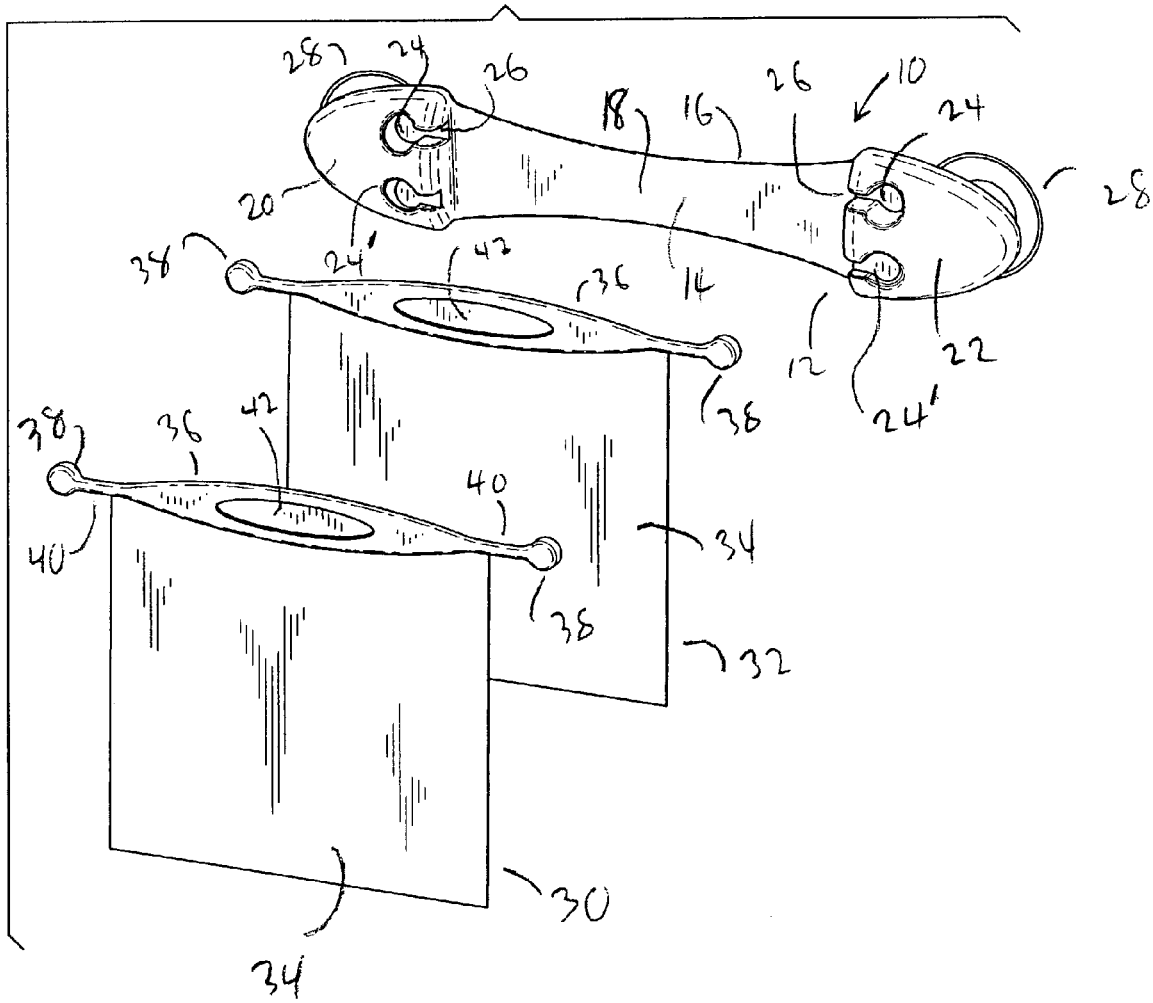
FIG. 2 is a perspective view of the same first embodiment of the present invention showing two window covering samples removed from the apparatus.
Figure 3:
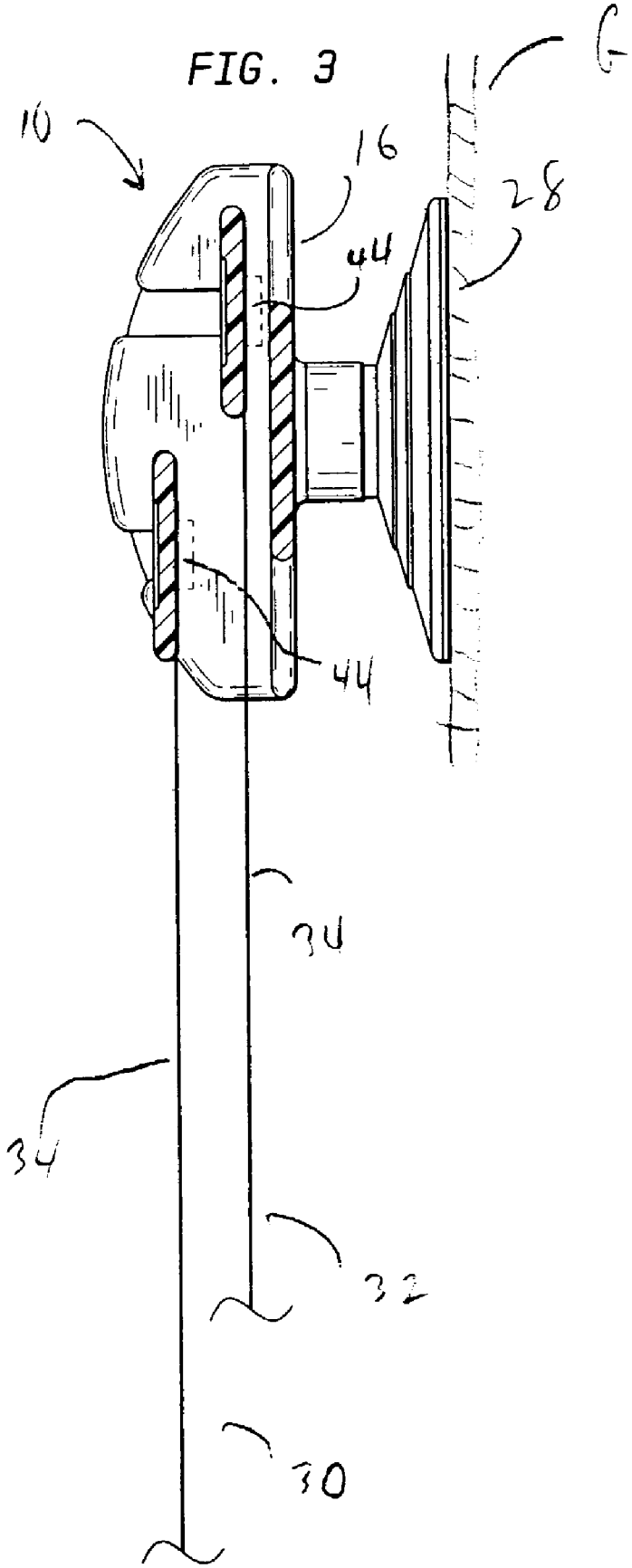
FIG. 3 is a cross-sectional view taken along line 3—3 in FIG. 1.

Turning now to the drawings and particularly the embodiment shown in FIGS. 1–3, the apparatus of the present invention is shown generally by reference numeral 10. The apparatus 10 includes a base 12 that has a front 14 and a rear 16.

The base 12 includes a central portion 18 and first and second end portions 20 and 22. The central portion 18 and the first and second end portions 20 and 22 may preferably be constructed integrally from a single piece of suitable material, such as plastic. Alternatively, the central portion 18 may be made of fabric or other flexible material. However, for reasons which will become apparent below, it is essential that the central portion 18 be substantially inelastic, such that when the first and second end portions 20 and 22 are stretched apart, they will be spaced apart from each other by a fixed, preselected distance.

As best seen in FIG. 2, each of the end portions 20, 22, which are shaped generally like arrow heads, has a pair of supports in the form of recesses 24, 24'. Each of recesses 24, 24' has a generally cylindrical portion toward the outer edge of the end portion 20 or 22, and a narrower neck 26 that opens to the edge of the end portion 20, 22 which faces the center portion 18.

Mounted on the rear surface 16 of the base 12 are suction cups 28. Suction cups 28 will preferably be any conventional rubber or plastic suction cup that is capable of being releasably engaged with a smooth flat surface, such as the glass pane G of a window, as in FIG. 3.

Referring again to FIGS. 1 and 2, illustrated thereon are first and second fabric samples 30, 32. Each of fabric samples 30 and 32 includes a fabric portion 34, which is the actual fabric that is being considered for use in a window covering.

Each of fabric samples 30 and 32 also includes a hanger 36 mounted at the top thereof. The hangers 36 are preferably formed from rigid material such as plastic, and the fabric portions 34 are mounted to the hangers 36 by any conventional means such as adhesive or the like.

At the end of each hanger 36 is a rounded knob 38. It will be appreciated that the knobs 38 will be substantially cylindrically shaped and sized so that they will fit within recesses 24. Adjacent to each knob 38 is a neck portion 40 which is sufficiently narrow such that it will fit within opening 26. In addition, hanger 36 may include a handle 42 to facilitate removing samples 30, 32 from a sample case (not shown).

As seen in FIGS. 1–3, each end portion 20, 22 has two recesses, with one recess 24 toward the upper end of end portions 20, 22 and one recess 241 below it, toward the lower end of end portions 20, 22.

Each of the recesses 24, 24' has a preselected depth. The recesses 24 proximate the upper ends of end portions 20 and 22 will preferably be deeper than the recesses 24' proximate the lower ends of end portions 20, 22.

Positioned in the interior of recesses 24 are permanent magnets 44. The surfaces of knobs 38 which are adapted to be placed within the recesses 24 will include at least a portion made of steel or other ferrous material that is adapted to be attracted to and releasably held by permanent magnets 44.

When fabric samples 30 and 32 are mounted to the apparatus 10, it will be seen that fabric sample 32 is mounted first, with the knobs 38 associated therewith positioned in the upper recesses 24, which recesses (as noted previously) are deeper than the lower recesses 24'. Once fabric sample 32 is mounted, fabric sample 30 is mounted, with its knobs 38 positioned in the lower recesses 24' of the apparatus 10, which recesses are shallower than the upper recesses. The interaction of the permanent magnets 44 and the steel or other ferrous metal portions of knobs 38 will cause the fabric samples 30, 32 to be mounted on the apparatus 10 without a risk of the fabric samples 30, 32 accidentally falling out. It will be appreciated by those skilled in the art that instead of having permanent magnets 44 mounted within the end portions 20, 22, one can instead mount permanent magnets on the rear surfaces of the knobs 38, and have a steel or other ferrous metal surface within the recesses 24, 24', achieving the same result.

As can now be best seen in FIG. 3, when both fabric samples 32 and 34 are mounted to the apparatus 10, the fabric portions 34 will hang parallel to each other. When apparatus 10 is mounted to a window pane by means of suction cups 28 being adhered to glass pane G, the fabric portions 34 of samples 30, 32 will hang parallel to each other and to the glass pane G. It will also now be apparent that the spacing between the fabric portions 34 of samples 30 and 32 will be approximately equal to the difference in depth between the upper recesses 24 and the lower recesses 24'.

It will thus be appreciated that if the difference in depth between the upper recesses 24 and the lower recesses 24' is approximately the same as the distance between the two different fabrics that will form part of the window covering that is to be built, the present invention thus permits a prospective customer to observe the two fabric samples 34 mounted on his or her own window in substantially the same relationship as will exist when the full window covering is assembled. In a preferred embodiment, this spacing is between about ½" and about 1", and preferably about ¾".

Figure 4:
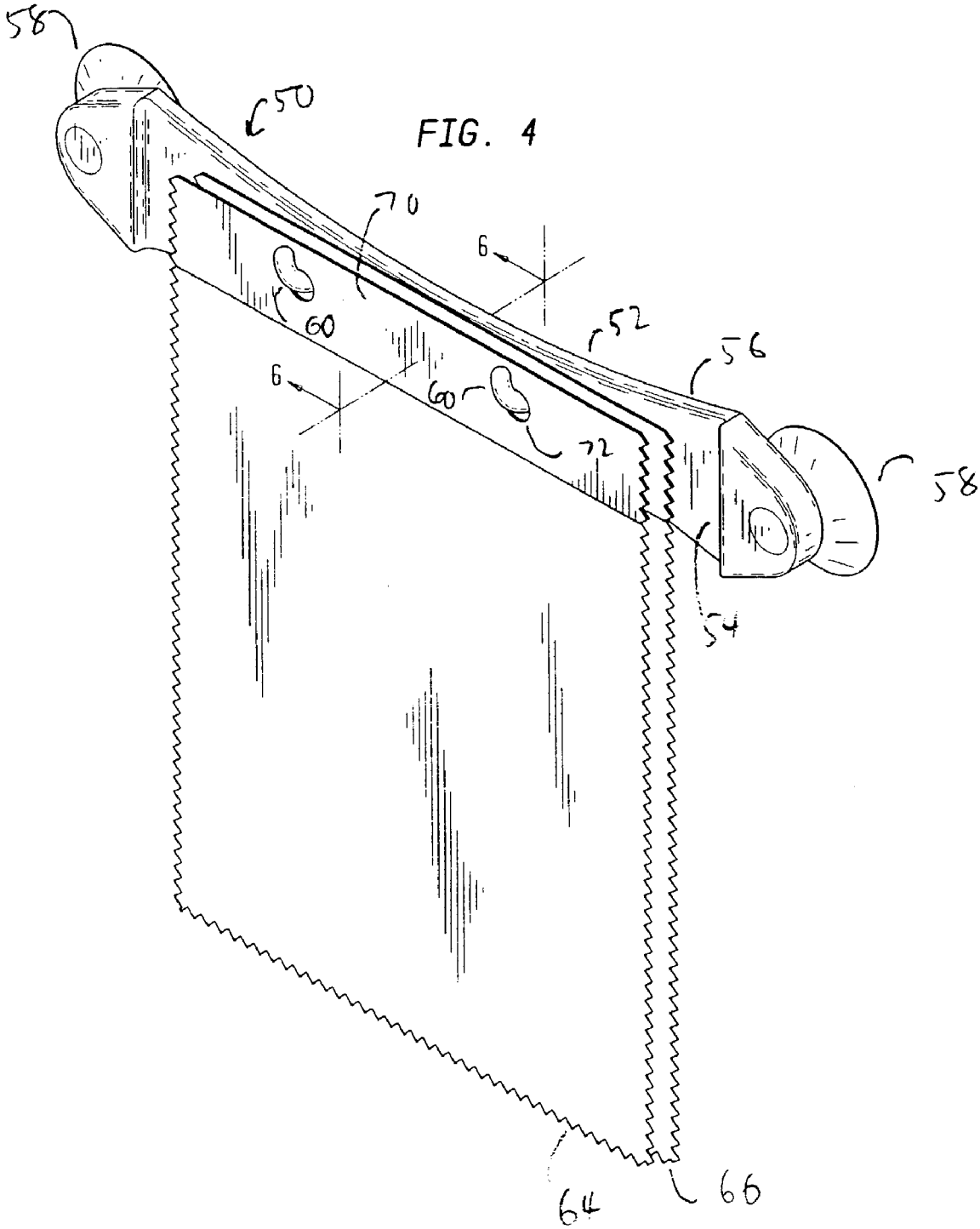
FIG. 4 is a perspective view of a second embodiment of the present invention with two window covering samples mounted thereon.
Figure 5:
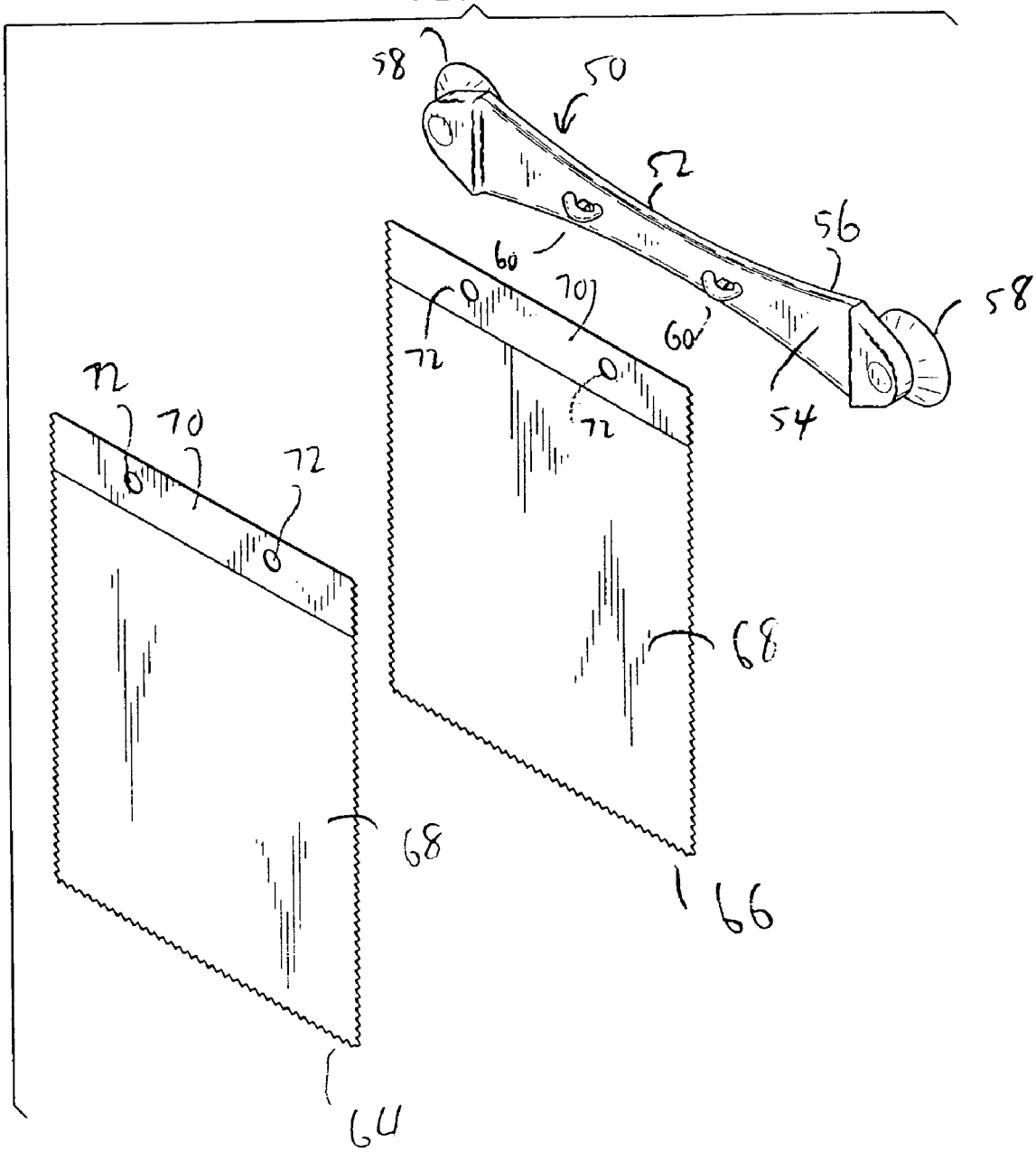
FIG. 5 is a perspective view of the same second embodiment of the present invention showing two window covering samples removed from the apparatus.
Figure 6:
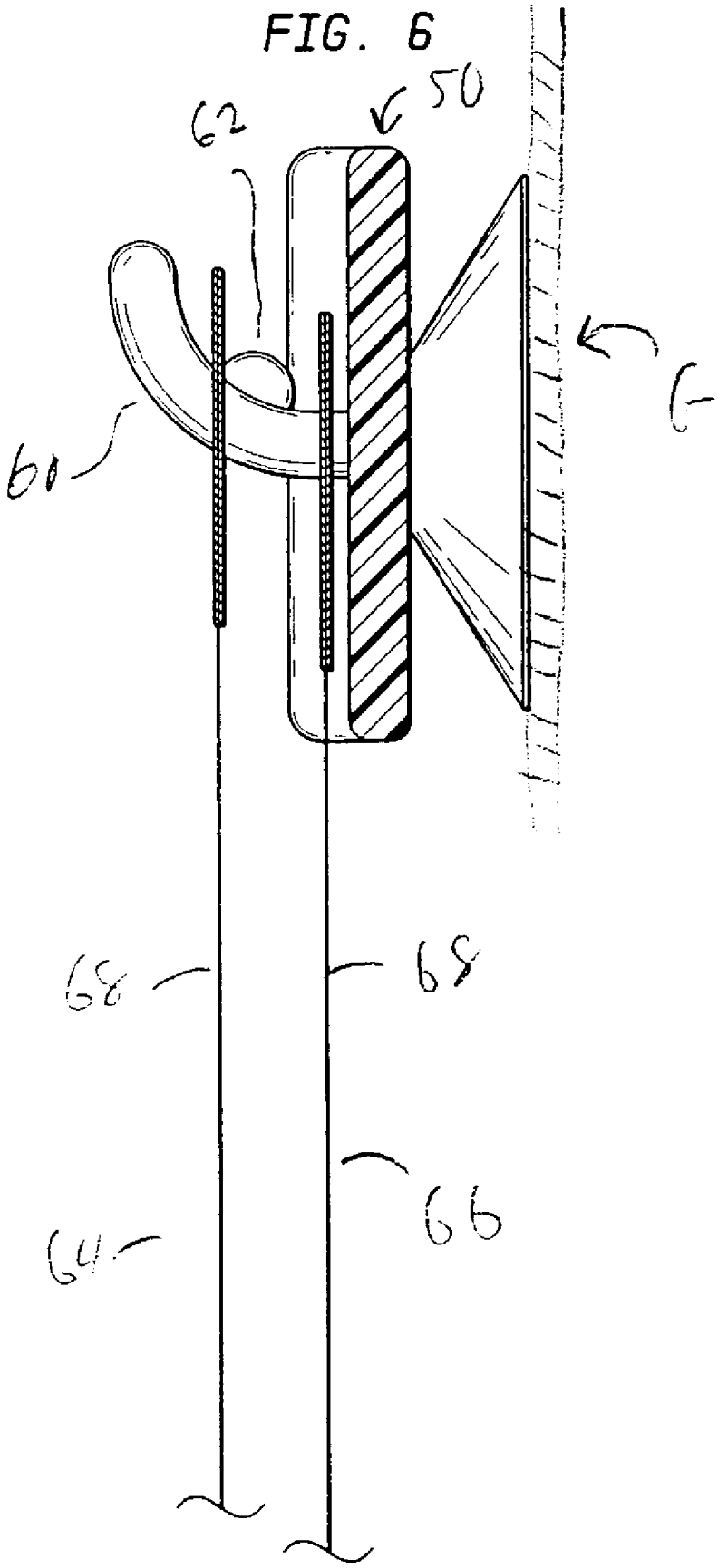
FIG. 6 is a cross-sectional view taken along 6—6 in FIG. 1.

Turning now to FIGS. 4–6, a second embodiment of the present invention is disclosed. An apparatus 50 includes a base 52 which is preferably a single, longitudinally extending piece of plastic or other appropriate material. The base 52 has a front surface 54 and a rear surface 56. Suction cups 58 are mounted to the rear surface 56 of base 52 in the same manner as discussed in connection with the embodiment of FIGS. 1–3.

As best seen in FIGS. 5 and 6, extending outwardly from the front 54 of base 52 are projections 60, which are generally shaped as upwardly curving hooks. As best seen in FIG. 6, projection 60 also includes a rounded, upwardly projecting spacer 62.

The use of apparatus 50 will now be discussed in conjunction with two fabric samples 64, 66. Each of fabric samples 64 and 66 has a fabric portion 68 and a support portion 70. Within the upper support portion 70 are two holes 72 which are spaced apart from each other by the same distance as projections 60 are spaced apart from each other. In addition, the diameter of the holes 72 is large enough so that the holes 72 may be slipped over the projections 60, including the rounded upwardly projecting spacer 62, if so desired.

As now best seen in FIGS. 4 and 6, the apparatus 50 is shown with fabric samples 64 and 66 mounted thereon. Fabric sample 66 is mounted to the apparatus 50 first, so that essentially the entirety of extensions 60, including the rounded upwardly projecting spacer 62, are passed through the openings 72 in fabric sample 66. The support portion 70 of fabric sample 66 thus rests in a first support position close to the front surface 54 of the apparatus 50. Fabric sample 64 may then be mounted on the apparatus 50, but is positioned in a second support position so as to be held in place at a distance from front surface 54 by the upwardly projecting spacer 62, as best shown in FIG. 6. It will thus be appreciated that by mounting the fabric samples 64 and 66 in this fashion, the two fabric samples 64 and 66 have their respective fabric portions 68 suspended parallel to each other and to the glass G, and spaced apart from each other by a distance determined by the placement of rounded upwardly projecting spacer 62 from the front surface 54 of apparatus 50.

Thus, as with the embodiment shown in FIGS. 1–3, two fabric samples may be mounted to the apparatus 50 in such a manner as to approximate the relationship that will exist when the window covering is assembled.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. An assembly for displaying samples of window coverings, the assembly comprising:

at least two fabric samples;

a base having a front and a rear;

at least one suction cup mounted on the rear of said base and being adapted to releasably engage a flat surface; and at least one projection on said base, said projection having a first portion and a second portion separated by a spacer, said at least one projection releasably receiving and holding said at least two fabric samples, such that said fabric samples are suspended substantially parallel to said flat surface with a space between said at least two fabric samples.

2. The assembly according to claim 1, wherein said base has first and second ends and wherein said at least one suction cup is mounted on the rear of said base proximate each of said first and second ends.

3. The assembly according to claim 1, wherein said at least one suction cup is adapted to engage a vertical surface, such that said at least two fabric samples are suspended in a substantially vertical plane.

4. An apparatus for displaying samples of window coverings comprising:

a first fabric sample and a second fabric sample;

a base having a front and a rear;

a means for releasably engaging a flat surface, said means disposed on said rear of said base; and a means for releasably receiving and positioning said first fabric sample and said second fabric sample on said base; said means adapted so that said first fabric sample and said second fabric sample are suspended substantially parallel to said flat surface and said second fabric sample is positioned at a greater difference from said flat surface than said first fabric sample to define a space between said first and second fabric samples.

5. An apparatus for displaying samples of window coverings comprising:

a base having a front and a rear, said base further including at least one projection extending outwardly from said front, said projection including a first portion having a first surface and a second portion having a second surface;

a separator element positioned between said first portion and said second portion such that said first surface is not contiguous with said second surface of said second portion; and a first fabric sample and a second fabric sample, each sample having a support portion for engaging said first portion or said second portion of said protrusion, wherein when said support portion of said first fabric sample engages said first surface or said second surface of said protrusion and said support portion of said second fabric sample engages the other of said first surface or said second surface, said support portions of said respective fabric samples being remote from one another.

6. The apparatus according to claim 5, wherein said separator element is a spacer integrally formed with said protrusion.

7. The apparatus according to claim 6, further comprising at least one suction cup mounted on said rear of said base and adapted to releasably engage a flat surface.

8. The apparatus according to claim 7, wherein said base has first and second ends and wherein at least one suction cup is mounted on said rear of said base proximate each of said first and second ends.

9. The apparatus according to claim 7, wherein said at least one suction cup is adapted to engage a vertical surface, such that said first fabric sample and said second fabric sample are suspended in a substantially vertical plane.

10. The apparatus according to claim 5, further comprising an attachment mechanism mounted on said rear of said base and adapted to releasably engage a flat surface.

11. The apparatus according to claim 10, wherein said attachment mechanism includes at least one suction cup.

12. The apparatus according to claim 5, wherein two projections extend outwardly from said first surface, each capable of engaging said support portion of said first and second fabric samples.

13. An apparatus for displaying samples of window coverings comprising:

a first fabric sample and a second fabric sample, each having a support portion; and a base having a front and a rear, said base further including at least one projection extending outwardly from said front, said at least one projection having a separating means adapted for separating said at least one projection into a first portion and a second portion;

wherein said support portion of said first fabric sample engages said projection along said first portion and said support portion of said second fabric sample engages said second portion, such that said support portion of each of said fabric samples cannot share a contiguous surface.

14. The apparatus according to claim 13, further comprising an attachment means for attaching said base to a flat surface.

15. The apparatus according to claim 14, wherein said attachment means includes at least one suction cup mounted to said rear of said base.

16. The apparatus according to claim 13, wherein said separating means includes a spacer positioned between said first portion and said second portion of said at least one projection.

17. The apparatus according to claim 16, wherein said base includes two projections extending outwardly from said front, each having a spacer.

18. The apparatus according to claim 13, wherein said fabric samples are aligned parallel to one another and said second fabric sample is positioned at a greater distance from said base than said first fabric sample.

* * * * *

UNITED STATES PATENT AND TRADEMARK OFFICE

CERTIFICATE OF CORRECTION

PATENT NO. : 7,059,482 B2
APPLICATION NO. : 10/395513
DATED : June 13, 2006
INVENTOR(S) : Patrick Reid et al.

It is certified that error appears in the above-identified patent and that said Letters Patent is hereby corrected as shown below:

On the Title Page item (75) delete "Brian Lump, Oak Park, IL (US); Michael P. Eckert, Lake Bluff, IL (US)".
Column 1, line 31, delete "is" and insert therefor --are--.
Column 2, line 13, delete "an" and insert therefor --and--.
Column 3, line 10, delete "1" and insert therefor --4--.
Column 4, line 67, delete "are" and insert therefor --is--.

Signed and Sealed this

Twelfth Day of February, 2008

JON W. DUDAS
*Director of the United States Patent and Trademark Office*